US006154982A

United States Patent [19]

Bell et al.

[11] Patent Number: 6,154,982

[45] Date of Patent: Dec. 5, 2000

[54] READILY MOUNTABLE TRACTION ENHANCING ATTACHMENT FOR FOOTWEAR

[75] Inventors: Michael Bell, 758 Rydal Green Dr., Rydal, Pa. 19046; Jonathan Marc Bell, Maple Glen; Eric P. Bell, Philadelphia, both of Pa.

[73] Assignee: Michael Bell, Rydal, Pa.

[21] Appl. No.: 09/378,251

[22] Filed: Aug. 20, 1999

[51] Int. Cl.[7] ..... A43B 3/16

[52] U.S. Cl. ..... 36/7.6; 36/7.3

[58] Field of Search ..... 36/7.3, 7.5, 7.6, 36/7.4

[56] References Cited

U.S. PATENT DOCUMENTS

| | | |
|---|---|---|
| 1,032,600 | 7/1912 | Grout . |
| 1,716,790 | 6/1929 | Mitchell . |
| 1,747,603 | 2/1930 | Ruth . |
| 1,877,080 | 9/1932 | Teshima . |
| 2,076,316 | 4/1937 | Beals, Jr. . |
| 2,189,489 | 2/1940 | Fritz . |
| 2,193,943 | 3/1940 | Shea . |
| 2,361,972 | 11/1944 | Smith . |
| 2,617,209 | 11/1952 | Jackson . |
| 2,628,437 | 2/1953 | Forsythe . |
| 3,012,343 | 12/1961 | Dinkel . |
| 3,026,635 | 3/1962 | Slade . |
| 3,040,451 | 6/1962 | Hilkemeyer . |
| 3,214,850 | 11/1965 | McNair . |
| 3,516,181 | 6/1970 | Jordan . |
| 3,609,888 | 10/1971 | Rickman . |
| 4,299,037 | 11/1981 | Carey . |
| 4,302,890 | 12/1981 | Covell et al. . |
| 4,344,238 | 8/1982 | Peyser . |
| 4,353,172 | 10/1982 | Bryant . |
| 4,525,939 | 7/1985 | NcNeil et al. . |
| 4,727,662 | 3/1988 | Ilon . |
| 4,807,372 | 2/1989 | McCall . |
| 4,910,883 | 3/1990 | Zock, Jr. . |
| 4,924,608 | 5/1990 | Mogonye . |
| 5,315,767 | 5/1994 | Bradbury . |
| 5,341,582 | 8/1994 | Liautaud . |
| 5,485,687 | 1/1996 | Rohde . |
| 5,689,901 | 11/1997 | Bell et al. . |
| 5,813,143 | 9/1998 | Bell et al. . |
| 5,950,334 | 9/1999 | Gerhardt . |

*Primary Examiner*—Ted Kavanaugh

*Attorney, Agent, or Firm*—Caesar, Rivise, Bernstein, Cohen & Pokotilow, Ltd.

[57] ABSTRACT

A footwear attachment device for releasable mounting on primary footwear, e.g., a boot or shoe, to provide enhanced traction. The primary footwear has an upper including a toe portion and a heel portion, a sole including a fore-foot portion and a heel portion. The attachment device comprising an integral member having been formed of an elastic material and having an upper portion and a sole portion. The sole portion is a generally planar member having a forefoot section, a heel section and a longitudinal axis extending therealong. The upper portion includes a toe-box section and a heel counter section. The toe box section is formed of at least one strip of elastic material and is secured to the forefoot portion of the sole to receive the toe portion of the primary footwear. The heel counter section is arranged to receive the heel portion of the primary footwear and includes a rear strip formed of elastic material mounted to normally extend upward at approximately a ninety degree angle to the plane of the heel section at the rear end thereof and a pair of side strips which extend upward from the heel portion on lateral sides thereof and which merge with the rear strip. A pair of tabs are located on the side strips to facilitate the mounting and dismounting of the device on the primary footwear. The sole portion has a ground engaging surface, e.g., grooves and plural cleats/spikes, to providing enhance traction.

8 Claims, 4 Drawing Sheets

READILY MOUNTABLE TRACTION ENHANCING ATTACHMENT FOR FOOTWEAR

BACKGROUND OF THE INVENTION

This application relates generally to footwear and more particularly to attachments which are adapted to be readily mounted to the upper of an article of primary footwear, e.g., a shoe or boot, so that a portion of the attachment is on the sole/heel of the primary footwear to provide enhanced traction.

Various ice gripping, sandal-like, attachments for footwear are commercially available and have been disclosed in the patent literature. Examples of such patented devices are found in the following U.S. Pat. No. 1,032,600 (Grout); U.S. Pat. No. 2,361,972 (Smith); U.S. Pat. No. 3,214,850 (McNair); U.S. Pat. No. 3,516,181 (Jordan); U.S. Pat. No. 4,344,238 (Peyser); U.S. Pat. No. 4,353,172 (Bryant); U.S. Pat. No. 4,525,939 (McNeil et al.); and U.S. Pat. No. 4,910,883 (Zock, Jr.).

There are also some spike or cleat-bearing attachments which are commercially available for use on footwear to prevent slippage on ice or other slippery surfaces. One such type of attachment is sold under the trademark "RUD Shoe Chain" and is a rubber ring having chains extending between opposed portions of the ring. The rubber ring is arranged to be stretched over the upper of a boot or shoe so that the chains extend under the sole and heel to provide traction on ice and snow.

Another type of attachment is sold under the trademark SPIKY and is in the form of a resilient rubber sling or overshoe having plural metal spikes or cleats on the bottom thereof and which are arranged to dig into ice when the attachment is worn over an article of primary footwear, e.g., a boot or shoe.

While the aforementioned prior art devices are generally suitable for their intended purposes, they still leave something to be desired from various standpoints, such as simplicity of construction, compactness, ease of mounting and removing, integrity of components and effectiveness.

Other prior art attachment devices for footwear are shown in the following U.S. Pat. No. 1,716,790 (Mitchell), U.S. Pat. No. 1,747,603 (Ruth), U.S. Pat. No. 1,877,080 (Teshima), U.S. Pat. No. 2,076,316 (Beals, Jr.), U.S. Pat. No. 2,617,209 (Jackson), U.S. Pat. No. 2,628,437 (Forsythe), U.S. Pat. No. 3,012,343 (Dinkel), U.S. Pat. No. 3,040,451 (Helkemeyer), U.S. Pat. No. 3,609,888 (Rickman), U.S. Pat. No. 4,807,372 (McCall), U.S. Pat. No. 4,302,890 (Covell et al.), U.S. Pat. No. 4,727,662 (Ilon), U.S. Pat. No. 4,924,608 (Mongonye), U.S. Pat. No. 5,485,687 (Rohde), and U.S. Pat. No. 5,341,582 (Liautand). All of the aforementioned devices also suffer from one or more drawbacks.

OBJECTS OF THE INVENTION

Accordingly, it is a general object of this invention to provide an attachment device for use on primary footwear, e.g., a boot, shoe, etc., which overcomes the disadvantages of the prior art.

It is another object of this invention to provide an attachment device for primary footwear which is arranged to be easily mounted on the footwear and easily removed therefrom, yet is resistant to accidental dismounting.

It is another object of this invention to provide an attachment device for primary footwear including a ground engaging portion having plural cleats or spikes for providing increased traction and which is held securely in place on the sole of the footwear to ensure that at least one cleat/spike is located on the heel strike area of the footwear.

It is another object of this invention to provide an attachment device for primary footwear which is simple in construction and which can be molded as a one-piece unit of a resilient material.

It is another object of this invention to provide an attachment device for primary footwear which can be molded as a one-piece unit of a resilient material having a thinner upper portion and a thicker sole portion.

It is another object of this invention to provide an attachment device for primary footwear which can be molded as a one-piece unit of a resilient material having a thinner upper portion facilitating the mounting of the device on the footwear and a thicker sole portion providing a base for mounting plural cleats or spikes formed of a hard material thereon so that the cleats/spikes do not become dislodged during repeated use of the device.

It is another object of this invention to provide an attachment device for primary footwear which can be molded as a one-piece unit of a resilient material having a thinner upper portion facilitating the mounting of the device on the footwear and a thicker sole portion providing a durable, traction enhancing, ground engaging surface.

It is another object of this invention to provide an attachment device for primary footwear which can be molded as a one-piece unit of a resilient material having a thinner upper portion facilitating the mounting of the device on the primary footwear and a thicker sole portion providing good cushioning for the wearer.

It is another object of this invention to provide an attachment device for primary footwear which can be molded as a one-piece unit of a resilient material having a thinner upper portion facilitating the mounting of the device on the primary footwear and a thicker sole portion enabling substantial depth recesses or grooves to be formed therein to provide traction enhancing, ground engaging surface.

It is still another object of this invention to provide an attachment device for primary footwear which includes a heel counter section for receipt of the heel counter portion of the primary footwear and having portions arranged to be readily grasped, even with gloved hands, to facilitate the mounting of the device on the footwear.

SUMMARY OF THE INVENTION

These and other objects of the subject invention are achieved by providing a footwear attachment device for releasable mounting on an article of footwear (primary footwear) to provide enhanced traction. The primary footwear has an upper including a toe portion and a heel portion, a sole including a fore-foot portion and a heel portion.

The attachment device comprises an integral member formed of an elastic material and having an upper portion and a sole portion. The sole portion is a generally planar member having a forefoot section, a heel section and a longitudinal axis extending therealong. The heel section terminates in a rear end. The front section terminates in a front end. The upper portion includes a toe-box section and a heel counter section. The toe box section is arranged to receive the toe portion of the primary footwear and is formed of at least one strip of elastic material and is secured to the forefoot portion of the sole adjacent the front end. The heel counter section is arranged to receive the heel portion of the primary footwear and includes a rear strip formed of elastic material mounted to normally extend upward at approximately a ninety degree angle to the plane of the heel section at the rear end thereof, and a pair of side strips which extend upward from the heel portion on lateral sides of the longitudinal axis and which merge with the rear strip. The sole portion has a ground engaging surface for providing enhanced traction.

In accordance with one preferred aspect of this invention portions of the upper are formed so that they will stretch more readily than portions of the sole to enable the device to be readily mounted and dismounted on the primary footwear. For example, the device is molded as an integral unit of a resilient material, with portions of the upper being thinner to stretch more readily than portions of the sole. The thicker portions of the sole provide durability and cushioning for the device.

In accordance with another preferred aspect of this invention, a plurality of cleats or spikes formed of a hard material are mounted on the sole to form at least a portion of the ground engaging surface. Moreover, the ground engaging portion also includes at least one recess formed in the sole portion to further enhance traction.

DESCRIPTION OF THE DRAWING

Other objects and many attendant features of this invention will become readily appreciated as the same becomes better understood by reference to the following detailed description when considered in connection with the accompanying drawing wherein.

DETAILED DESCRIPTION OF THE PREFERRED EMBODIMENTS

Figure 1:
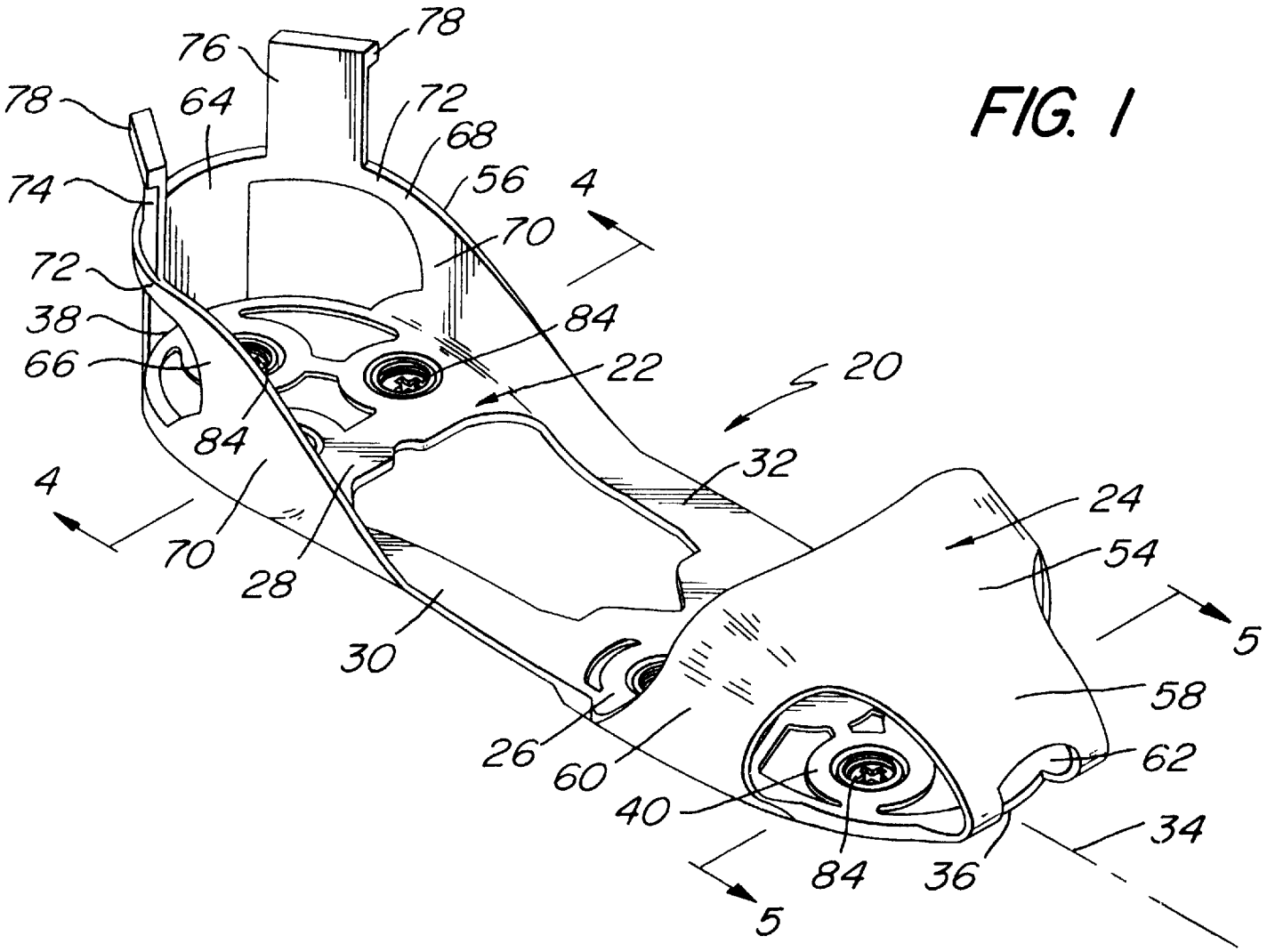
FIG. 1 is an isometric view of the attachment device of the subject invention.

Referring now to various figures of the drawing where like reference numerals refer to like parts there is shown at 20 in FIG. 1, a footwear attachment device constructed in accordance with this invention for securement to any type of conventional footwear 10 (FIG. 2), e.g., a boot, having a sole 10A and an upper 10B, to render it resistant to slippage on slippery surfaces. In accordance with one preferred embodiment of this invention the attachment device includes a traction-enhancing, ground engaging surface including plural piercing cleats or spikes formed of a hard material. The ground engaging surface serves to enhance traction in all types of slippery conditions, including smooth ice. For those slippery conditions where ice-piercing cleats or spikes are not appropriate or desired, the attachment devices of this invention may merely include a traction enhancing tread surface. The details of the traction enhancing ground engaging surface of the device 20 will be described later.

Figure 2:
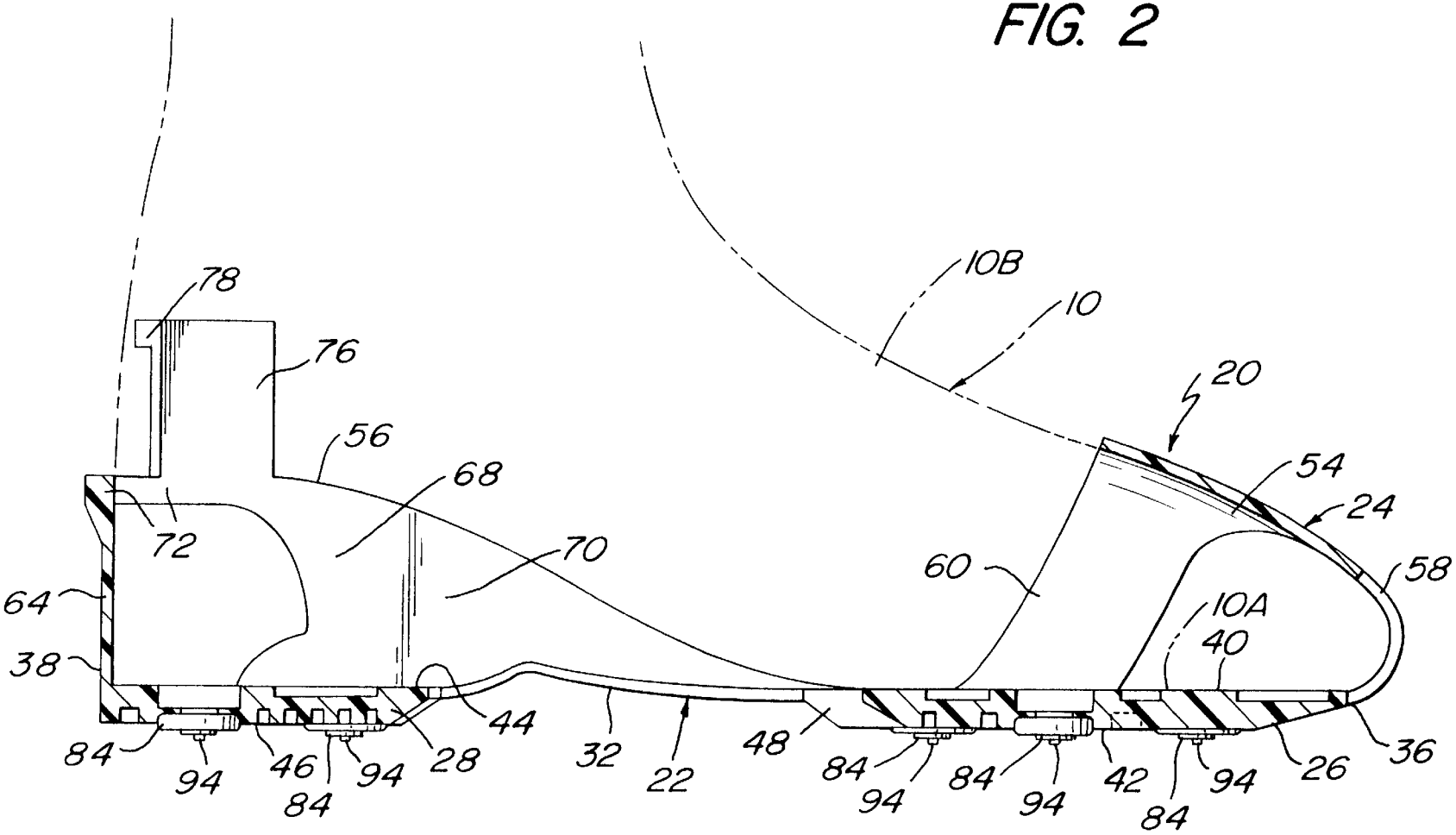
FIG. 2 is an enlarged longitudinal sectional view of the attachment device mounted on a conventional article of footwear (the footwear being shown by phantom lines)

As will be described in detail later the attachment device 20 of this invention is preferably formed (e.g., molded) as a one-piece or unitary member of a flexible and resilient material, e.g., rubber, PVC, TPR etc., in the interests of manufacturing simplicity and economy. To that end, as can be seen in FIG. 2 the attachment device 20 basically comprises a generally planar sole portion 22 and a contoured upper portion 24 all molded as an integral or one-piece member. The sole portion 22 includes a forefoot-sole section or pad 26, a heel-sole section or pad 28, and a pair of connecting webs 30 and 32. The sole portion includes a longitudinal central axis 34 extending from the front or toe edge 36 of the forefoot-sole section to the rear or heel edge 38 of the heel-sole section. The forefoot-sole section 26 includes an inner surface 40 and an outer, ground engaging surface 42, the details of which will be described later. The forefoot sole section 26 is relatively thick, e.g., 8 mm, for enhanced cushioning and durability. In a similar manner the heel-sole section 28 includes an inner surface 44 and an outer, ground engaging surface 46, the details of which will also be described later. The heel-sole section 28 is preferably the same thickness as the forefoot sole section 26 for the same reasons.

Figure 3:
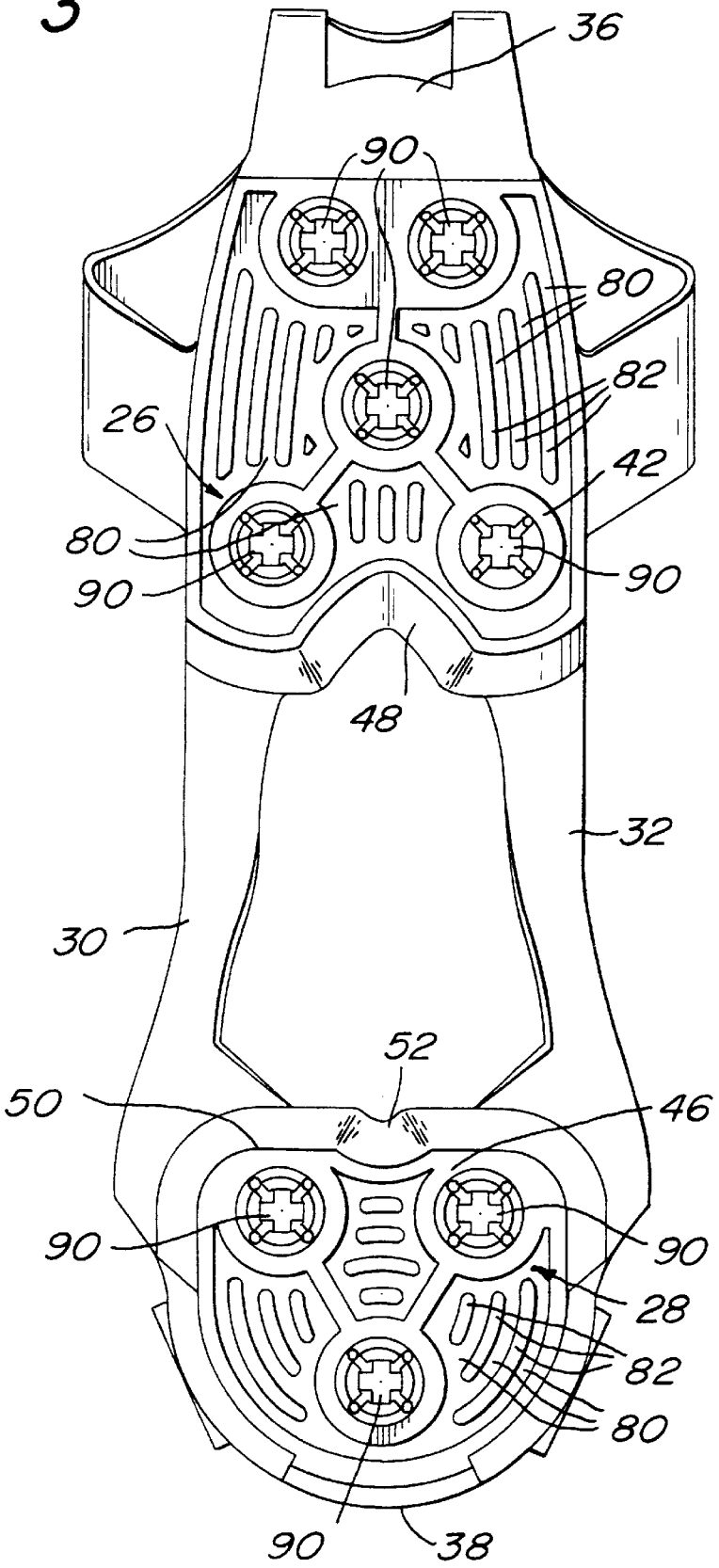
FIG. 3 is a bottom plan view of the attachment device shown in FIG. 1 but without the optional spikes or cleats which may be made part of the device.

The forefoot-sole portion or pad 26 is a generally planar member of irregular, but longitudinally symmetrical shape. In particular, as best seen in Fig.3, the section 26 is of somewhat "arrow-headed" shape having a generally straight or blunt front end which forms the toe edge 36, and a somewhat "V-shaped" or notched rear end 48. The front end of the webs 30 and 32 are connected to the forefoot-sole section 26 on opposite sides of the notched rear end 48.

The heel-sole section 28 is also a generally planar member of irregular, but longitudinally symmetrical shape. In this case, as best seen in FIG. 3, the section 28 is of somewhat "D-shape" having a generally straight or blunt front end 50 and an arcuate rear end which forms the heel edge 38. A small recess 52 is centrally located in the front end of the heel-sole section. The rear end of the webs 30 and 32 are connected to the heel-sole section 26 on opposite sides of blunt front end 50.

The connecting webs 30 and 32 are each relatively thin, e.g., 3 mm, to enable them to stretch so that the attachment device can be easily put on and removed from the primary footwear, yet provide sufficient resistance to stretching to prevent accidental displacement of the attachment from the footwear during use.

As best seen in FIGS. 1, 2, 4 and 5, the upper portion 24 basically comprises a toe-box section 54 and a heel counter section 56. The toe-box section is a generally T-shaped member which comprises a front strap 58 and a cross strap 60. The front strap 58 projects outward from the toe edge 36 of the forefoot-sole section and is bent back over itself to terminate above the toe edge, where it merges with the cross strap 60. The cross strap 60 projects outward from one side of the forefoot-sole section 26 adjacent the rear end thereof, then bends upward and over the forefoot-sole section so that it crosses that section generally perpendicularly to the longitudinal axis 34, and then bends downward to merge with the opposite side of the forefoot-sole section. As best seen in FIGS. 1 and 2, the cross strap 60 is oriented at an acute angle directed toward the front end of the attachment device. This arrangement produces a hollow interior for the toe-box to receive the toe portion of the primary footwear snugly therein. An opening 62 having linear sides is provided in the front strap 58 contiguous with the toe end 36 of the forefoot-sole section to readily accommodate the front tip of the primary footwear, by enabling the front strap to readily stretch thereabout. In order to enable the toe-box section to readily accommodate the toe portion of the primary footwear the straps 58 and 60 are relatively thin, e.g., 3 mm, to enable them to be readily stretched.

Figure 4:
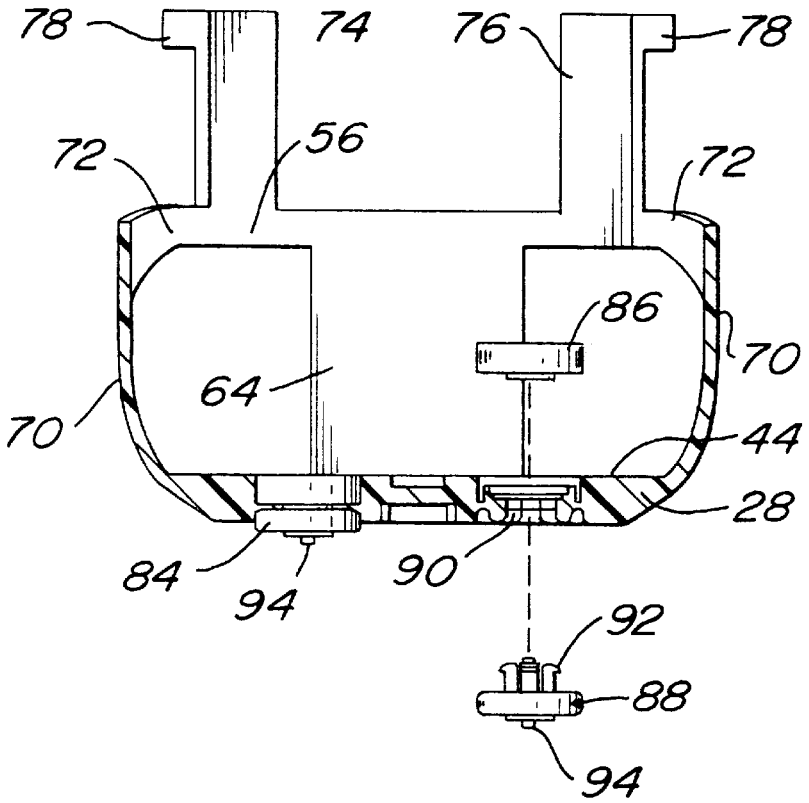
FIG. 4 is a sectional view taken along line 4—4 of FIG. 1.
Figure 5:
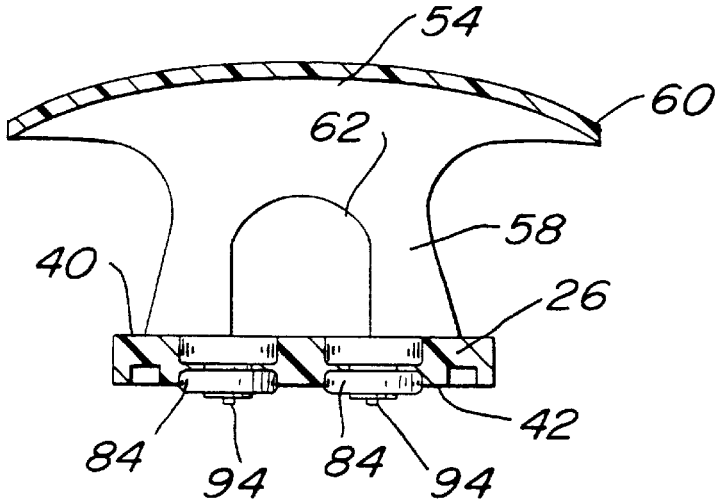
FIG. 5 is a sectional view taken along line 5—5 of FIG. 1.

Referring now to FIGS. 1, 2 and 4 the details of the heel-counter section 56 will now be described. Thus, as can be seen the heel-counter section includes a rear heel strap 64 and a pair of side straps 66 and 68. The rear heel strap 64 is an elongated member which normally extends upward from the rear edge 38 of the heel-sole section perpendicularly to the plane of that section (see FIG. 2) and is centered on the central longitudinal axis 34. Each of the side straps 66 and 68 include a generally triangular shaped lower portion 70 and a narrow upper strip portion 72. The lower portion of the side strap 66 merges with the connecting strap 30, while the lower portion of the side strap 68 merges with the connecting strap 32. The upper strip portion 72 projects rearwardly from the associated lower portion 70 of the side strap 66 and merges with the similarly oriented upper strip portion 72 of the side strap 68. The top end of the rear strap 64 merges at this same juncture. The lower portions 70 of the side straps 66 and 68 and the rear strap 64 are all relatively thin, e.g., 3 mm, to facilitate the stretching of those portions when the attachment device is put on or taken off. The two upper strip portions 72, however, are substantially thicker, e.g., approximately 7 mm square, than the lower portions 70 to provide resistance to stretching along the top edges of the rear of the heel counter. This feature tends to keep the heel portion of the upper 10B of the primary footwear 10 securely in place within the heel counter section 56 of the attachment device 20 against accidental dislodgement.

As discussed immediately above, the thinness of the portions of the device forming the upper 24 enables them to stretch readily to facilitate the mounting (and dismounting of the attachment device 20 onto various sizes of primary footwear 10. The sole portion, i.e., the forefoot-section or pad 26 and the heel section or pad 28, in contradistinction, are preferably sufficiently thick, e.g., 8 mm, to provide resistance to stretching and stability to the device. In addition the thickness of the pads provides additional cushioning and/or shock absorption over that provided by the primary footwear. Further still the thickness of the pads provides a good mounting base for the cleats or spikes (to be described later).

To further facilitate the mounting and dismounting of the device 20 on the primary footwear, a pair of pull tabs 74 and 76 are provided as part of the heel counter section 56. The tabs extend upward from the upper edge portion 72 of respective ones of the side straps 66 and 68, so that each tab lies on opposite sides of the central longitudinal axis 34 of the device. The top or free end of each tab is in the form of a thickened ear 78, which is arranged to be readily grasped between the thumb and forefinger of the user to provide a good, slip resistant gripping surface. This feature is of considerable utility for users of the device in icy, cold environments, since such users frequently wear heavy, motion restricting protective gloves or mittens.

The ground engaging surfaces 42 and 46 of the device 20 may be constructed so that they are identical or different, depending upon the desired application for the attachment. Moreover, those surfaces may be of any desired type to provide whatever type of traction is desired. For example, if it is desired that the attachment device be utilized for general slippery conditions the surfaces may include plural grooves 80 to define a plural ridges 82 therebetween. The grooves/ridges provide good traction on all but the iciest conditions. For such icy conditions, the ground engaging surfaces 42 and 46 preferably include ice-penetrating cleats or spikes 84. The device 20 including the optional cleats or spikes 84 is shown in FIGS. 1, 2, 4 and 5.

Each of the ice-engaging cleats/spikes 84 preferably is an assembly constructed in accordance with the teachings of a copending U.S. patent application Ser. No. 09/026,352, filed on Feb. 19, 1998, entitled Cleats For Footwear, whose disclosure is incorporated by reference herein, and which is assigned to the same assignee as this invention. In the interest of brevity all the details of the construction of the cleat/spikes will not be reiterated herein. Suffice it for now to state that as shown in FIG. 4 each cleat/spike 84 comprises an assembly of a base member or collar 86 and a projection member 88. Each member is preferably molded of a plastic material. The base member 88 is an annular ring having a central opening which is undercut and is arranged to be disposed within a respective aperture 90 formed, e.g., molded, in the forefoot-sole section or pad 26 and the heel-sole section or pad 28. The projection member 88 is formed of the same material as the base member and basically comprises a hub having a central longitudinal axis and a peripheral flange extending outward from the hub. The center of the projection member comprises a planar outer surface which extends outward slightly beyond the outer surface of the flange. An annular bead extends about the outer periphery of the flange on its inner surface. The hub includes four elongated fingers 92 extending in the opposite direction from the outer surface of the projection member. Each finger terminates in a free end in an ear having a cam surface. The fingers are arranged to be extended through the aperture 90 in the pads 26 and 28 and through the undercut central opening in the base member riding on their cam surfaces until their respective ears snap-connect to respective detent portions of the base member contiguous with the undercut central opening. This action tightly holds or sandwiches portions of the material forming the pads 26 and/or 28 contiguous with the aperture 90 between the flange's annular bead and the base member, rending the cleat assembly 84 resistant to disconnection even after repeated use.

Each projection member 88 includes a spike 94 extending outward slightly, e.g., ⅛ inch (2.3 mm) from the planar outer surface of the hub to penetrate ice or other slippery surfaces, thereby increasing traction provided by the attachment device. If desired the spike 94 may be formed of metal molded in situ in the projection member 88.

The cleats/spikes 84 are located at various positions spread out across the ground engaging portions of the forefoot-sole section and heel-sole section. At least one cleat is preferably located as close to the rear edge of the heel-sole section as possible. This location ensures that at least one cleat/spike will be in the "heel strike" zone or area when the user walks with the device in place, to thereby provide good resistance to slippage.

If it is desired to protect surface on which the attachment device will be used, e.g., a floor of a building, optional caps or covers (not shown) can be used for each of the cleat assemblies to cover their respective spikes. Each cover is preferably constructed in accordance with the teaching of the aforementioned patent application.

As should be appreciated from the foregoing the attachment devices of this invention are simple in construction and can be fabricated readily. Moreover, being molded of a resilient material they may be folded or rolled up into a compact configuration so that they can be conveniently stored or transported until ready for use, e.g., a worker can carry the attachments either unfolded or folded, unrolled or rolled in his/her pocket. When it is desired to use the devices, all that is necessary is to insert the toe portion of the primary footwear into the toe-box section of the attachment and then to pull the heel-counter section over the heel and contiguous portion of the upper so that the heel of the footwear is in place on the inner surface of the heel-sole section of the attachment. As will be appreciated by those skilled in the art, since the rear strap 64 extends upward from the rear edge of the heel-sole section, it provides a definitive and secure location for the rear edge of the heel of the primary footwear to prevent the primary footwear from slipping backward. This feature ensures that when the device is put on that the heel of the primary footwear is at the desired location and that the rear-most cleat(s)/spike(s) of the heel-sole section are located within the heel strike zone of the primary footwear when the wearer walks with the attachment device in place. Thus, once in place the device 20 is resistant to displacement on the footwear and offers great stability and resistance to slippage on wet, icy, snowy, muddy or other slippery conditions.

It should also be pointed out that while it is preferable to mold the attachment devices as an integral unit from a single material (with portions of different thicknesses to provide the desired amount of stretchability in the upper portion—and with minimal stretching of the pads of the sole portion), it is contemplated that the attachment devices can be molded of different materials, having different resiliency, hardness, etc., for the various parts of the devices, as desired.

The sloped surfaces forming the trailing edge portion 48 of the forefoot, sole section 26 provides an effective means to prevent the device from snagging on the ground and thereby reduces a tripping hazard when wearing the device. The sloped surface of the leading edge portion 50 serves the same function for the heel-sole section 28.

Without further elaboration the foregoing will so fully illustrate our invention that others may, by applying current or future knowledge, adopt the same for use under various conditions of service.

What is claimed is:

1. A footwear attachment device for releasable mounting on a primary footwear to enhance the traction provided thereby when a person walks with said attachment device mounted on the primary footwear, the primary footwear having an upper including a toe portion and a heel portion, a sole including a fore-foot portion and a heel portion, said attachment device being molded as a one-piece member of an elastic material and having an upper portion and a sole portion, said sole portion being a generally planar member having a forefoot section, a heel section and a longitudinal axis extending therealong, said heel section terminating in a rear end, said forefoot section terminating in a front end, said upper portion including a toe-box section and a heel counter section, said toe box section being formed of at least one strip of said elastic material and being secured to said forefoot section of said sole portion adjacent said front end for receipt of the toe portion of the primary footwear, said heel counter section including a rear strip formed of said elastic material and mounted to extend upward approximately perpendicularly to the plane of said heel section at said rear end and a pair of side strips which extend upward from said heel section on lateral sides of said longitudinal axis and which merge with said rear strip for receipt of the heel portion of the primary footwear, a substantial area of said forefoot section including thickened, generally planar portions encompassing a major portion of said forefoot section, said thickened portions of said forefoot section being greater in thickness than portions of said upper portion, a substantial area of said heel section including thickened, generally planar portions encompassing a major portion of said heel section, said thickened portions of said heel section being greater in thickness than portions of said upper portion, said thickened portions of said forefoot and heel sections comprising a ground engaging, traction enhancing surface and respective contoured recessed areas shaped to receive and retain a plurality of hard, non-elastic cleats or spikes therein resistant to accidental disconnection when said sole portion is flexed as the person walks with said device mounted on the primary footwear.

2. The attachment device of claim 1 wherein said ground engaging surface includes a plurality of cleats or spikes.

3. The attachment device of claim 2 wherein said ground engaging surface also includes at least one recess formed in said sole portion.

4. The attachment device of claim 3 wherein said cleats or spikes are formed of a hard material.

5. The attachment device of claim 2 wherein said cleats or spikes are formed of a hard material.

6. The attachment device of claim 1 wherein said ground engaging surface includes at least one recess formed in said sole portion.

7. The attachment device of claim 1 additionally comprising a pair of members projecting from opposite sides of said heel counter section to enable the wearer of said device to grasp said members to facilitate the mounting and dismounting of said device on the primary footwear.

8. The attachment device of claim 7 wherein each of said pair of members comprises a strip of material having a thickened free end.

* * * * *